US009809383B2

(12) United States Patent
Ford

(10) Patent No.: US 9,809,383 B2
(45) Date of Patent: Nov. 7, 2017

(54) REFUSE VEHICLE TRACK AND GUIDE SYSTEM

(71) Applicant: The Heil Co., Chattanooga, TN (US)

(72) Inventor: Richard Ford, Ringgold, GA (US)

(73) Assignee: The Heil Co., Chattanooga, TN (US)

( * ) Notice: Subject to any disclaimer, the term of this patent is extended or adjusted under 35 U.S.C. 154(b) by 184 days.

(21) Appl. No.: 14/246,733

(22) Filed: Apr. 7, 2014

(65) Prior Publication Data

US 2014/0341685 A1 Nov. 20, 2014

Related U.S. Application Data

(60) Provisional application No. 61/824,551, filed on May 17, 2013.

(51) Int. Cl.
*B65F 3/04* (2006.01)
*B65F 3/02* (2006.01)

(52) U.S. Cl.
CPC ..... *B65F 3/041* (2013.01); *B65F 2003/023* (2013.01); *B65F 2003/0279* (2013.01); *B65F 2003/0283* (2013.01)

(58) Field of Classification Search
CPC ..... B65F 2003/0279; B65F 2003/0246; B65F 3/046; B65F 3/04; B65F 3/001; B65F 3/041; B65F 3/08; B65F 1/122; B65F 3/24; B65F 3/02; B60P 1/50; B60P 1/48
See application file for complete search history.

(56) References Cited

U.S. PATENT DOCUMENTS

| | | | | |
|---|---|---|---|---|
| 2,643,011 A | | 6/1953 | Brisson et al. | |
| 2,784,853 A | | 3/1957 | Bowles | |
| 2,824,655 A | * | 2/1958 | Harbers | E02F 3/3486 414/486 |
| 2,984,374 A | * | 5/1961 | Herpich et al. | 414/408 |
| 3,074,570 A | * | 1/1963 | Walter | B60P 1/50 414/541 |
| 3,090,512 A | * | 5/1963 | Dempster | B60P 1/50 414/408 |
| 3,112,834 A | | 12/1963 | Dempster et al. | |
| 3,207,343 A | * | 9/1965 | Ord | 414/406 |
| 4,547,118 A | * | 10/1985 | Pittenger | 414/408 |
| 2005/0095096 A1 | * | 5/2005 | Curotto et al. | 414/406 |

* cited by examiner

*Primary Examiner* — Glenn Myers
(74) *Attorney, Agent, or Firm* — Harness, Dickey & Pierce, P.L.C.

(57) ABSTRACT

A track and guide system for a refuse vehicle has at least one track member mounted on a bumper of the refuse vehicle. The track member has a desired length extending transverse to the ground. At least one guide member is mounted on a front loading fork of the refuse vehicle. The at least one guide member contacts the at least one track member to prohibit horizontal movement of the front loading fork with respect to the refuse vehicle.

16 Claims, 11 Drawing Sheets

REFUSE VEHICLE TRACK AND GUIDE SYSTEM

CROSS-REFERENCE TO RELATED APPLICATION

This application claims the benefit of U.S. Provisional Application No. 61/824,551, filed on May 17, 2013. The entire disclosure of the above application is incorporated herein by reference.

FIELD

The present disclosure relates to refuse vehicles and, more particularly, to refuse vehicles with front loading forks and a track and guide system.

BACKGROUND

When picking up residential, as well as commercial refuse, refuse haulers attempt to maximize their refuse vehicle potential. Refuse vehicles with front loading forks can be utilized to pick up large intermediate containers at commercial buildings. Additionally, these types of vehicles can be utilized for receiving residential refuse at the rear of the vehicle. Recently, intermediate containers, that are maintained on the front loading forks and include garbage can gripping devices, have become more popular for picking up residential refuse. These intermediate containers include a self-contained arm that extends from the intermediate container. The arm grasps a garbage can and dumps the garbage can into the intermediate container. Once the intermediate container is full, the front loading forks dump the intermediate container into the hopper of the large permanent container on the vehicle.

While utilizing these intermediate containers with a grasping arm, it has been found that as the arm extends from the intermediate container, due to the fast cycle time, that substantial horizontal movement is created in the front loading forks. The further the arm extends from the intermediate container, the more likely horizontal movement of the front loading forks is to occur. The horizontal motion causes increased stress on the front loading forks. The front loading forks were originally designed to handle vertical forces from the operation of commercial container dump cycles. Accordingly, it would be desirous to prohibit horizontal movement of the front loading forks during pick up of residential refuse utilizing a front loading intermediate container with a self-contained gripping arm.

The present disclosure provides the art with a refuse vehicle that prohibits horizontal movement of the front loading forks utilizing an intermediate container during residential pick up. The present disclosure enables vertical movement of the intermediate container to adjust for garbage can height while prohibiting horizontal movement of the front loading forks. Additionally, the disclosure provides a simple and economical track and guide system that can be attached to existing refuse vehicles or can be original manufacturer's equipment.

SUMMARY

Accordingly to a first aspect of the disclosure, a track and guide system for refuse vehicles comprise at least one track member adapted to be mounted on a bumper of a refuse vehicle. The at least one track member has a desired length extending transverse to the ground. At least one guide member is adapted to be mounted on the front loading forks of the refuse vehicle. The at least one guide member contacts the at least one track member to prohibit horizontal movement of the front loading forks with respect to the refuse vehicle. Wear pads may be positioned on the track member or the guide member. Gusset plates are coupled with the track member and guide member to provide strength in a direction of an applied force. The length of the track member enables contact with the guide member as the front loading fork is raised vertically to adjust for height of a to be picked up can or container. The track member includes a first portion to be secured with the refuse vehicle bumper and a second portion to contact the guide member. The second portion is substantially transverse to the first portion.

According to a second aspect of the disclosure, a refuse vehicle comprises a vehicle chassis including a cab and a permanent container coupled with the rear portion of the chassis. Front loading forks are coupled with the refuse vehicle to dump an intermediate container into the permanent container on the rear of the chassis. At least one track member is mounted on a bumper of the chassis. The at least one track member has a desired length extending transverse to the ground. At least one guide member is mounted on the front loading forks. The at least one guide member contacts the at least one track member to prohibit horizontal movement of the front loading forks with respect to the refuse vehicle. Wear pads may be positioned on the track member or the guide member. Gusset plates are coupled with the track member and guide member to provide strength in a direction of an applied force. The length of the track member enables contact with the guide member as the front loading fork is raised vertically to adjust for height of a to be picked up can or container. The track member includes a first portion to be secured with the refuse vehicle bumper and a second portion to contact the guide member. The second portion is substantially transverse to the first portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
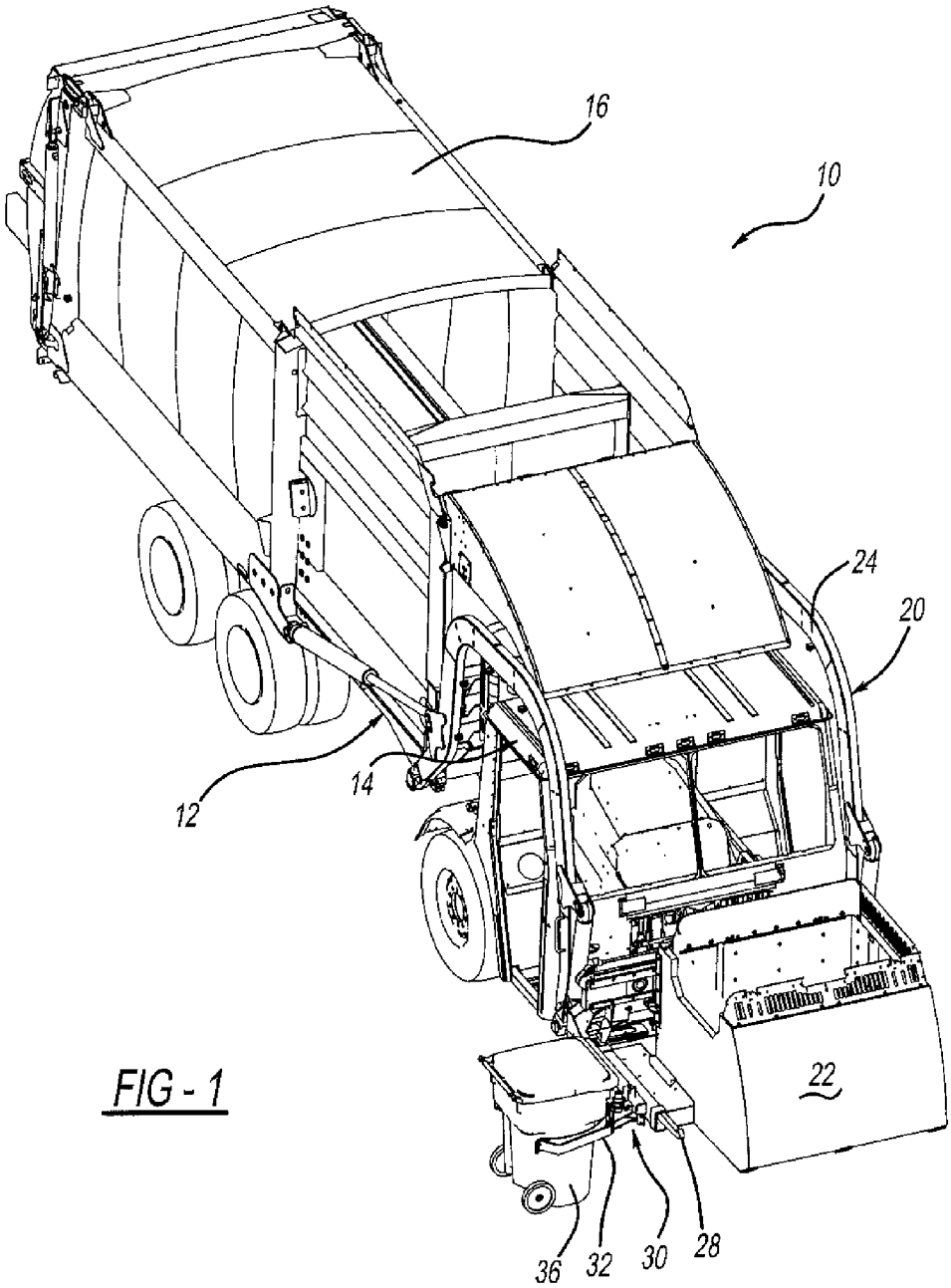
FIG. 1 is a perspective view of a refuse vehicle including an intermediate container with a collection arm grasping a garbage can or container.
Figure 2:
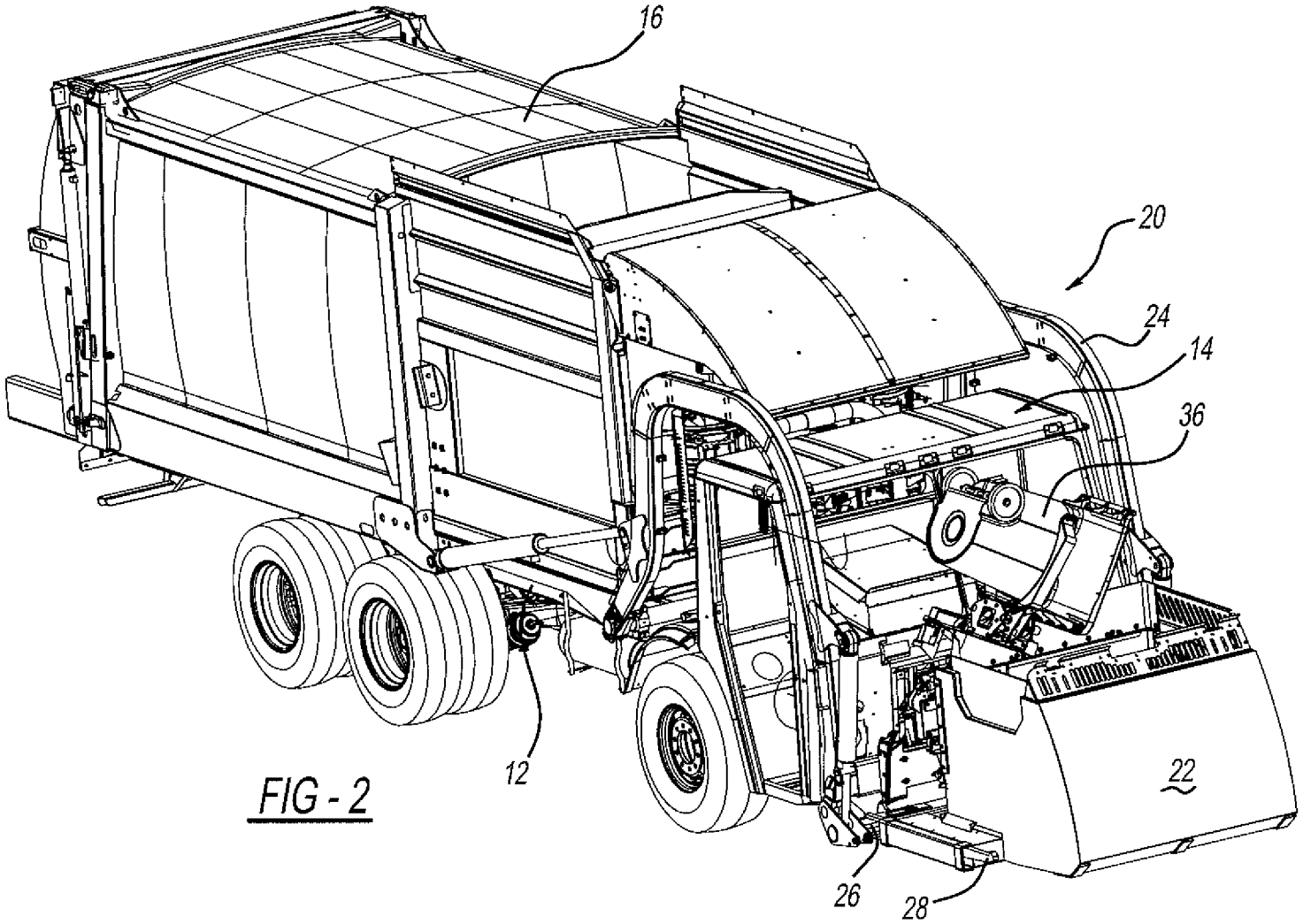
FIG. 2 is a view like FIG. 1 with the garbage can in a dump position.

Turning to the figures, particularly FIG. 1, a refuse vehicle is illustrated and designated with the reference numeral 10. The refuse vehicle 10 includes a chassis 12 with a cab 14 and a permanent rear container 16 positioned onto the rear of the chassis 12. The refuse vehicle 10 also includes front loading forks 20. The front loading forks 20 dump intermediate container 22 into the rear container 16. The forks 20 include a pair of side bars 24, a cross-bar 26 and tines 28. The front loading forks 20 dump the intermediate container 22 positioned on the tines 28 in a conventional manner. The intermediate container 22 includes an arm 30 with a gripper 32. The arm 30 extends from and retracts toward the intermediate container 22 to grasp and then dump a garbage can or container 36 into the intermediate container 22 as shown in FIG. 2.

Figure 3:
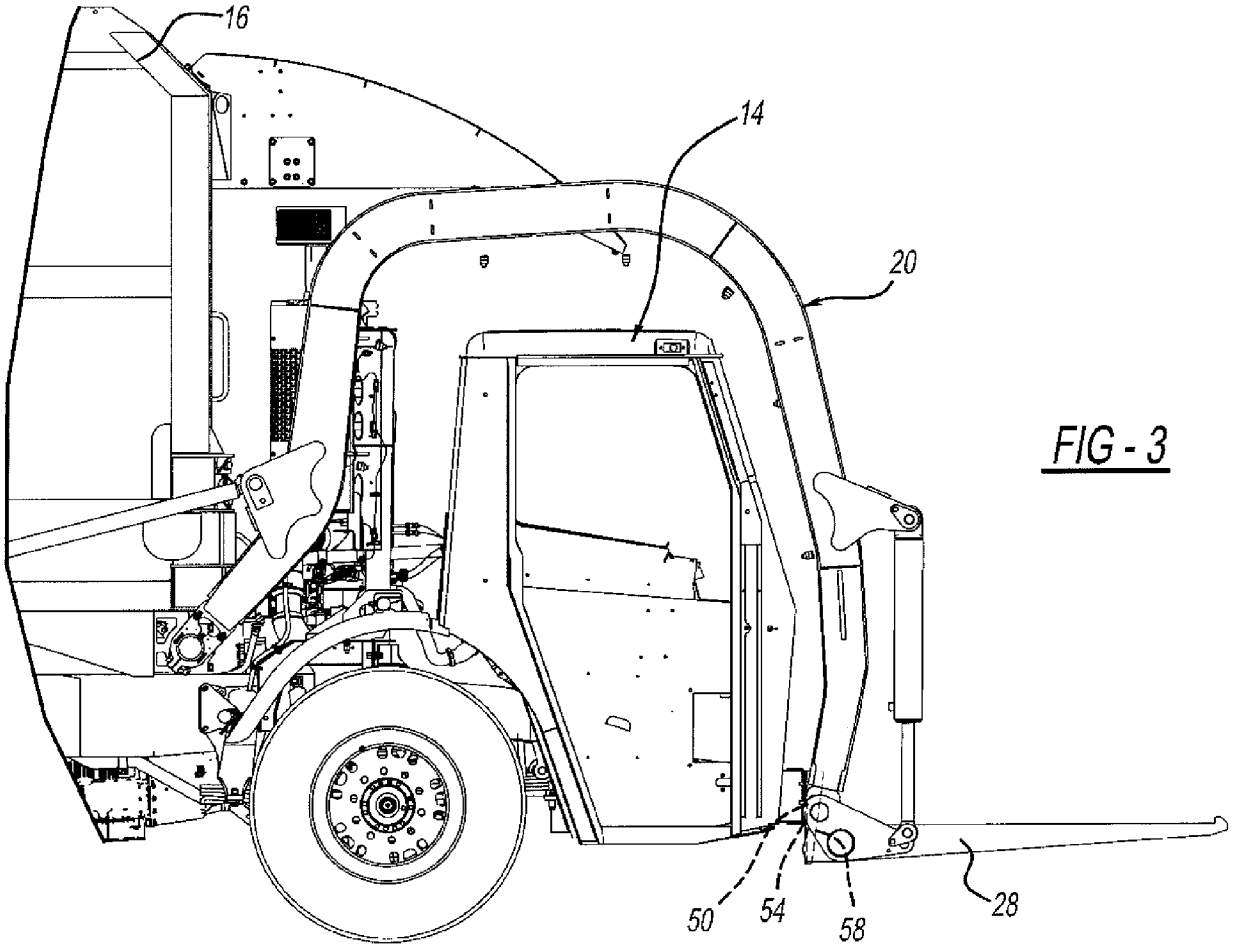
FIG. 3 is a schematic side view of a cab and front loading fork.
Figure 4:
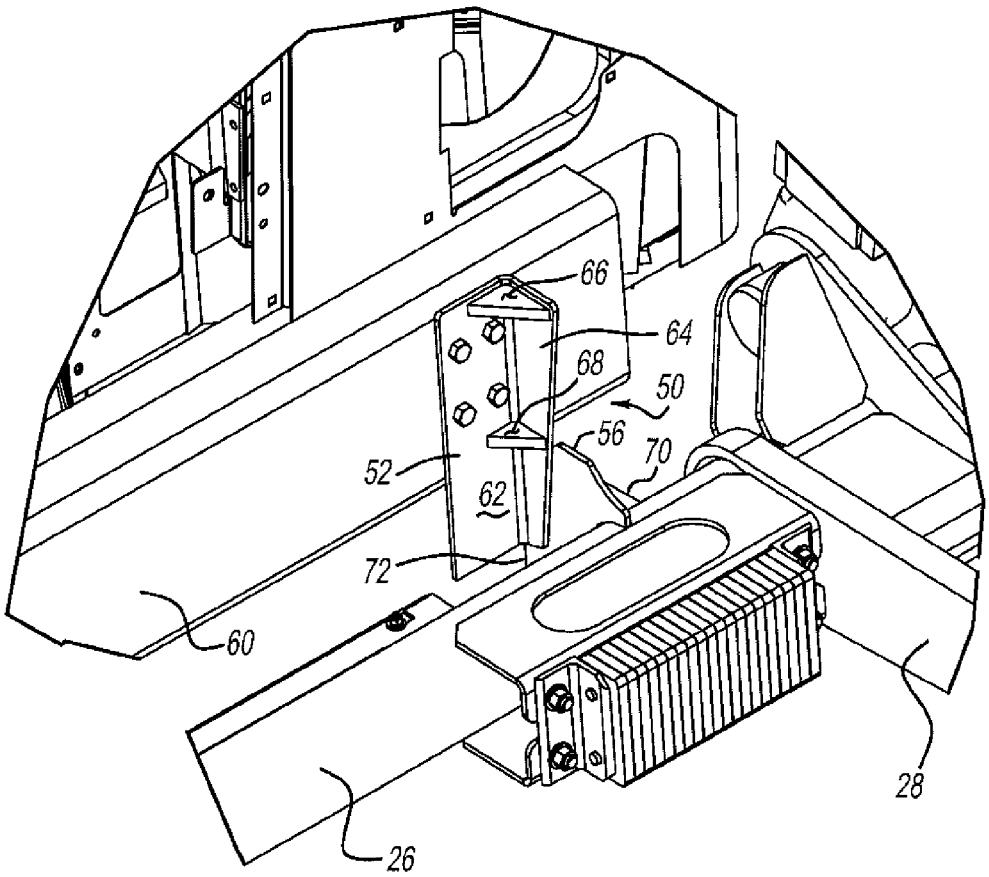
FIG. 4 is a perspective view of one side of the track and guide system.
Figure 5:
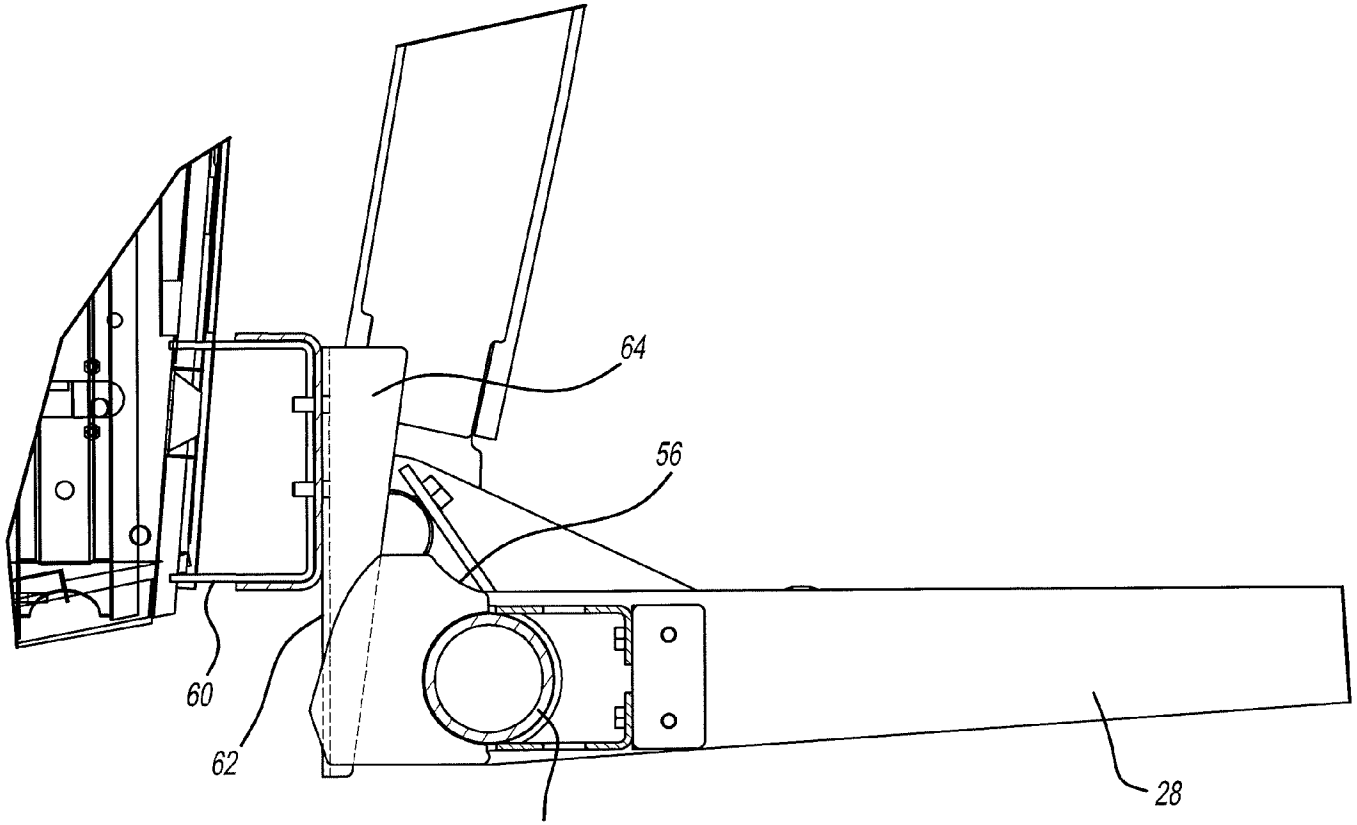
FIG. 5 is a side elevation view of FIG. 4.

Turning to FIGS. 3 and 4, the track and guide system is illustrated and designated with the reference numeral 50. The track and guide system 50 includes a pair of track members 52, 54 as well as a pair of guide members 56, 58. The track member 52 and guide member 56 are on the left side of the vehicle bumper 60, as illustrated in FIG. 4. The track member 54 and guide member 58, on the right side of the vehicle bumper, are illustrated in phantom in FIG. 3. The track members 52, 54 are identical but are right and left handed.

The track member 52 includes a first plate portion 62 and a second plate portion 64. The plate portions 62, 64 are positioned transverse to one another. The plate portion 62 is secured, bolted, welded or the like to the bumper 60. Gusset plates 66, 68 are welded to the first and second portions 62, 64. The gusset plates 66, 68 provide strength in the direction of the applied force. The second portion 64 has a desired length that extends below the bumper 60 of the vehicle 10. The length of the second member 64 of the track member 52 enables the guide member 56 to contact the second plate 64 below the bumper 60. This enables the front loading forks 20 to be moved vertically away from the ground along the second portion 64. This provides a vertical or height adjustment of the intermediate container 22. In turn, by being able to lift the front loading forks 20, the height of the intermediate container can be adjusted to accommodate different heights of garbage cans 36.

Figure 6:
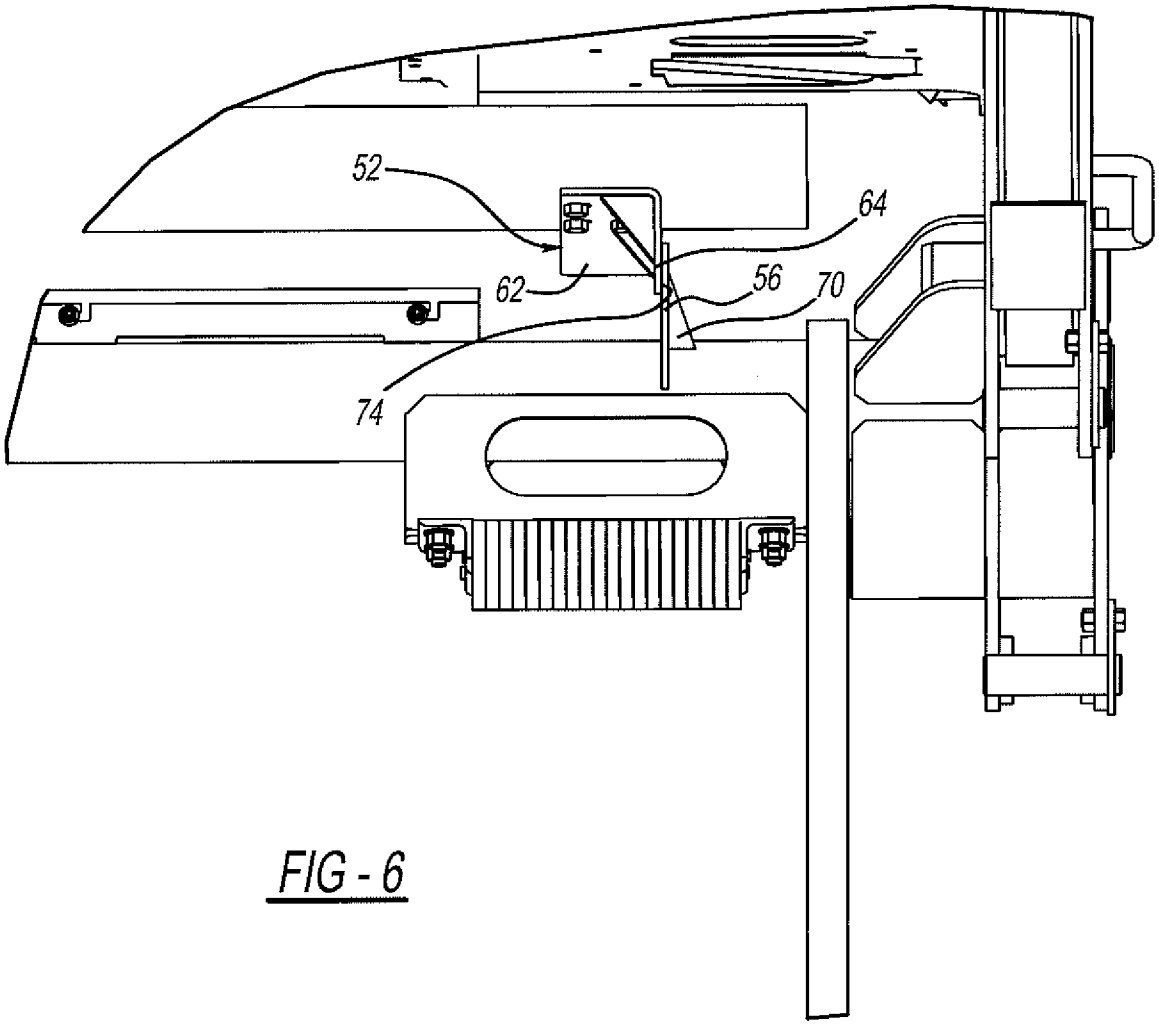
FIG. 6 is a top perspective view of FIG. 4.
Figure 7:
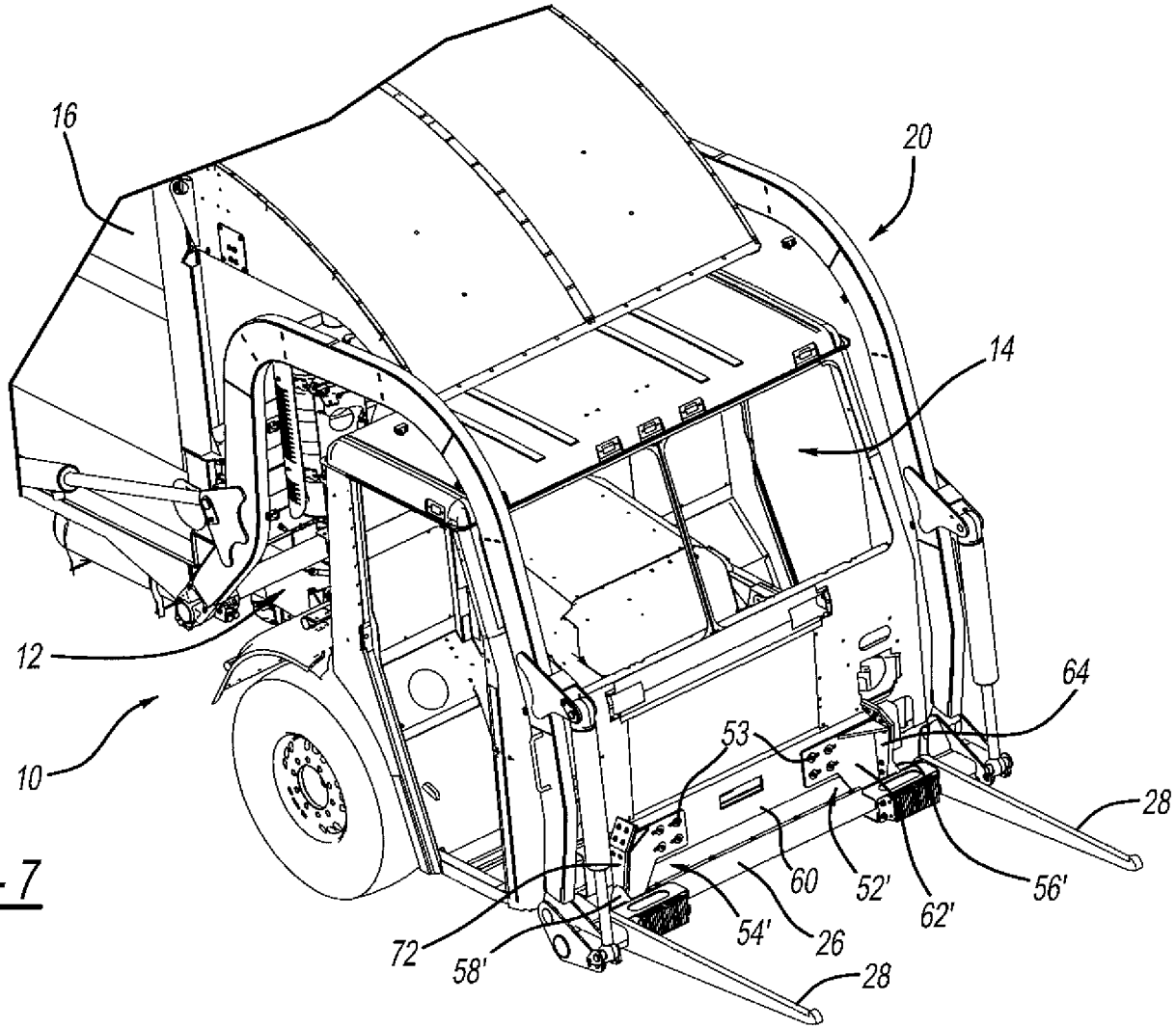
FIG. 7 is a perspective view of a second embodiment.
Figure 8:
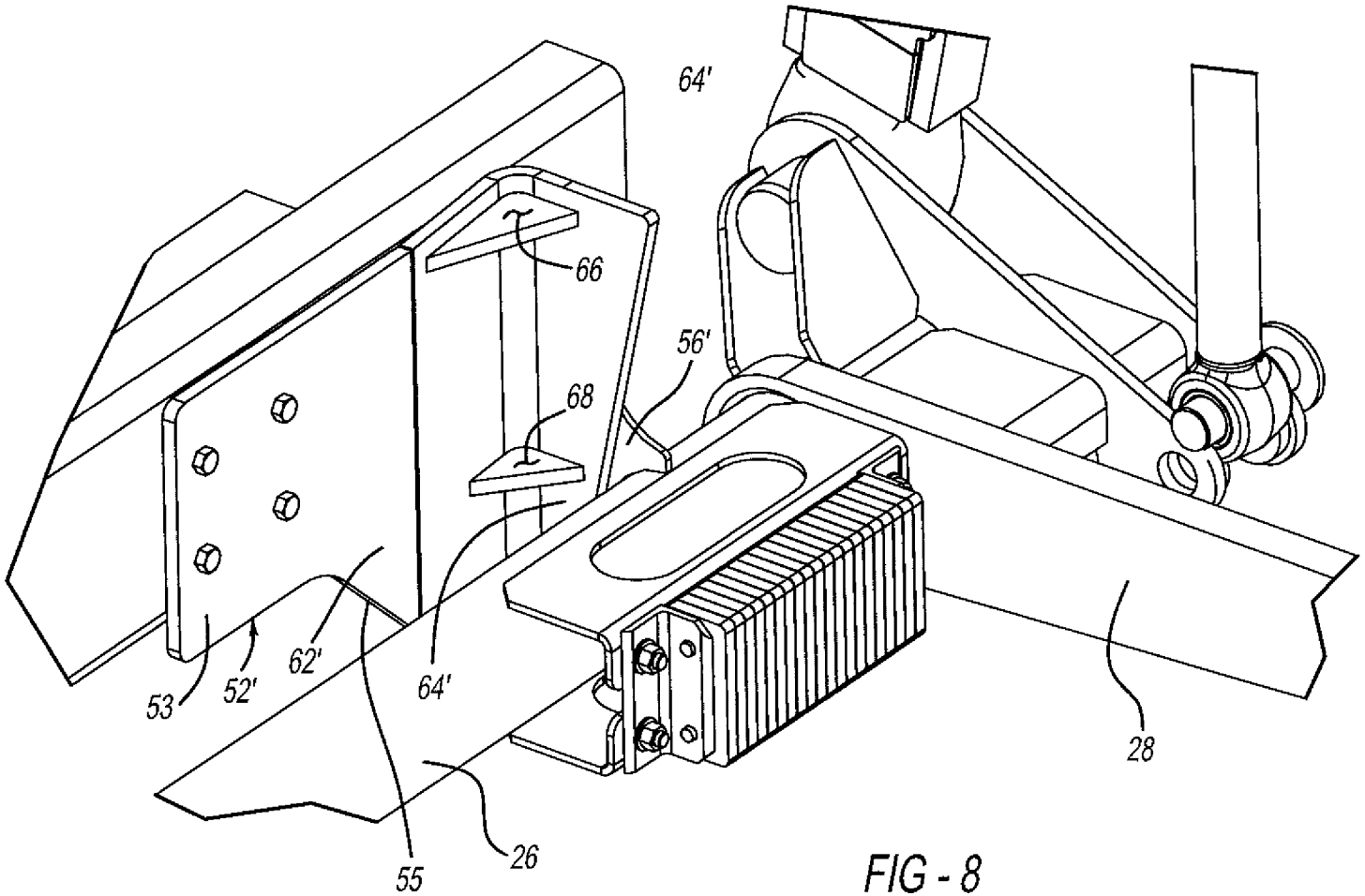
FIG. 8 is an enlarged perspective view of one of the track and guide members.
Figure 9:
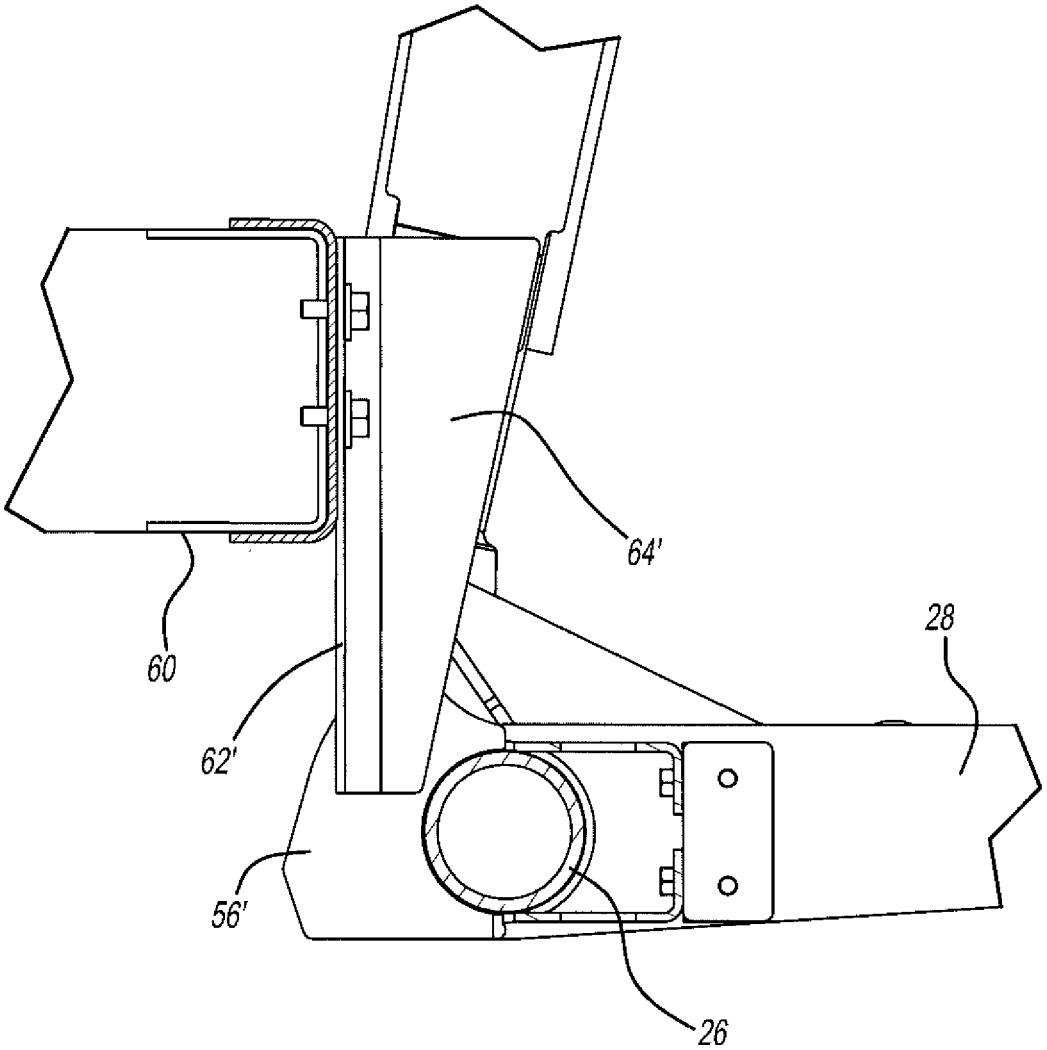
FIG. 9 is a side elevation view of FIG. 8.
Figure 10:
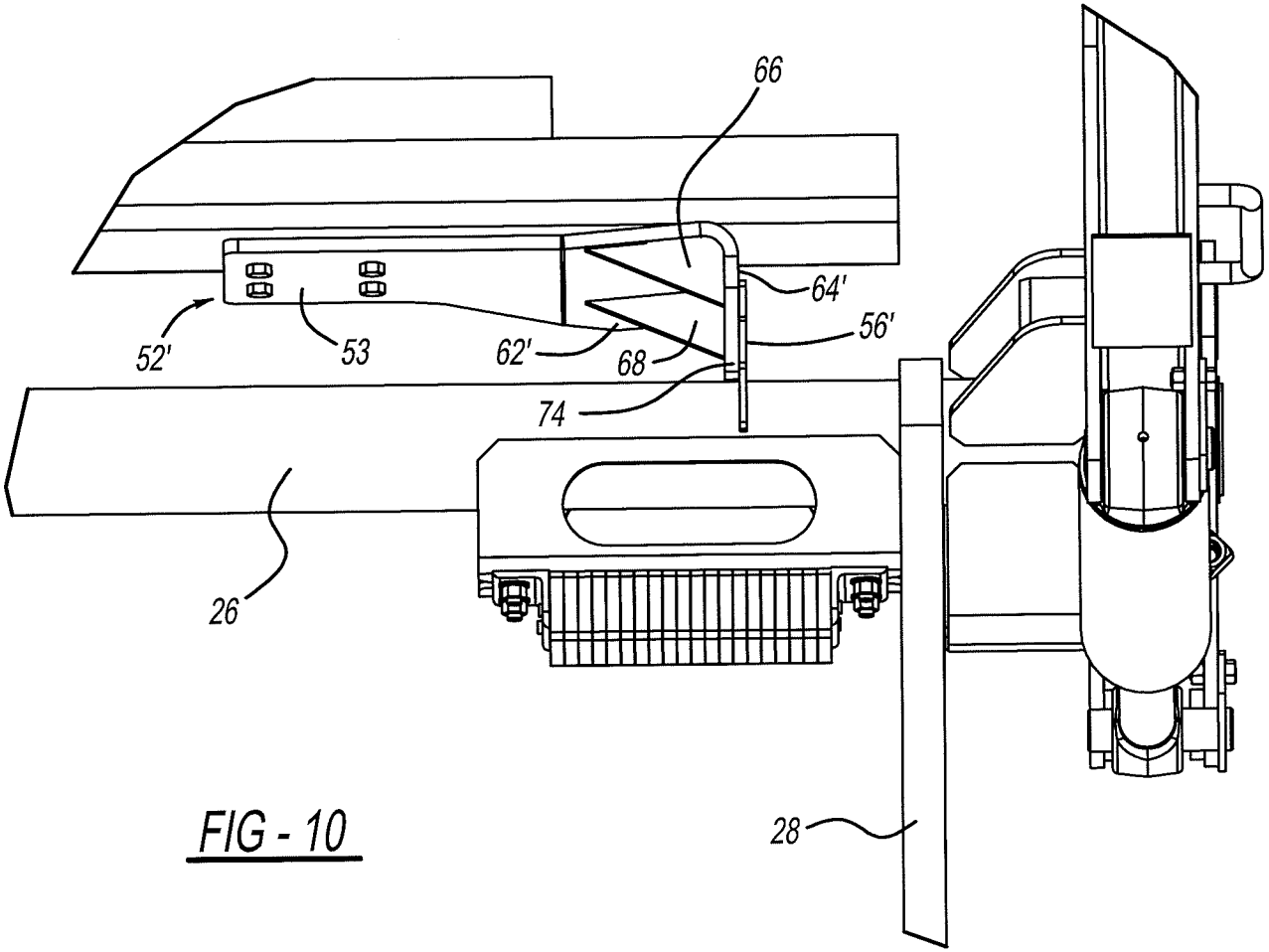
FIG. 10 is a top perspective view of FIG. 8.

The guide member 56 is coupled with the cross support 26. The guide member 56 is a plate having a desired configuration. As illustrated in FIG. 6, the plate member has an overall rectangular configuration. The plate member 56, as illustrated in FIG. 6, contacts the second portion 64 of the track member 52. Also, a gusset plate 70 may be welded to the guide plate 56 and the cross member 26 as illustrated in FIG. 6. The gusset plates 70 provide strength in the direction of the applied force. Additionally, a wear plate 72 may be applied to the contact surface of the second member 64 or the guide plate 56. Here, it is illustrated on the guide plate 56. This provides easy sliding and prohibits wear of the plates.

A gap is created between the track member second member 64 and the guide 56. The gap 74 is best illustrated in FIG. 6. The gap 74 is approximately a ⅛ inch wide. The gap 74 provides for installation tolerances. The contact edges of the track and guide should be chamfered to provide ease of docking when the front loading forks dump cycle is complete.

Turning to FIGS. 7-10, an additional embodiment is illustrated. Here, the same parts will be designated with the same reference numerals. The difference between the first embodiment and the second embodiment lies in the first portion of the track members 52', 54'. Here, the first plate portion 62' includes a bolting portion 53. The bolting portion 53 extends from the first portion 62'. The bolting portion 53 has a cut-out so that an inclined surface 55 extends to the first plate portion 62'. The track member 52' includes the gusset plates 66, 68 as well as the second portion 64' as previously described. Also, the guide members 56' and 58' have a slightly different configuration. However, the guide members 56' and 58' functions as previously described.

Figure 11:
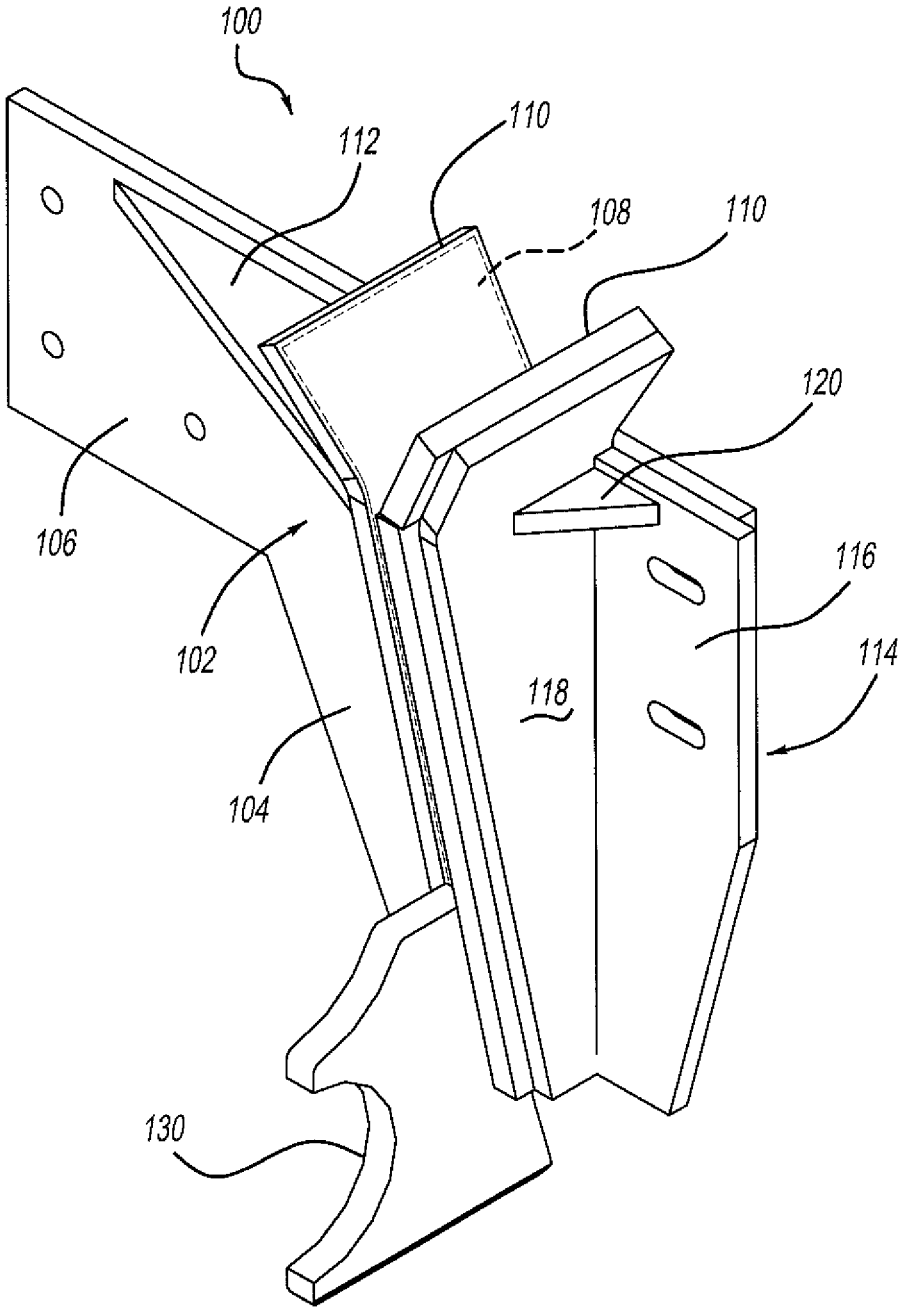
FIG. 11 is a schematic perspective view of a third embodiment.

FIG. 11 illustrates a third embodiment of a track and guide system 100. The track member 102 includes a first plate portion 104 that includes a bolting portion 106. A first member 108 extends transverse to the plate member 104. The first member 108 includes a wear pad 110. Additionally, a gusset 112 is secured with the transverse member 108 and bolting portion 106. The track member 102 includes a second plate member 114 that is positioned on the first plate member 104. The second plate member 114 includes a first plate portion 116 and a second plate portion 118 transverse to the first plate 116. A gusset 120 provides strength as previously described. Also, the second plate portion 118 includes a wear pad 110. A guide 130 is illustrated between the first member 108 and the second plate portion 118 to slide between the wear pads 110. The guide 130 would be secured to the cross bar 26 of the front loading forks 20. By moving between the first member 108 and second plate portion 118, a single track member 102 and guide member 130 can be utilized to prohibit horizontal movement of the front loading forks 20 during pick up of the intermediate container.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A track and guide system for a refuse vehicle comprising:

at least one track member with at least one lateral side in a plane, vertical with respect to the refuse vehicle, the at least one track member to be mounted on a bumper of the refuse vehicle, the at least one track member has a desired length extending transverse to the ground so that a portion of the at least one track member extends below the bumper of the refuse vehicle; and at least one guide member, the at least one guide member is to be mounted on a cross bar between a pair of side bars, pivotally coupled with the refuse vehicle, of a front loading fork of the refuse vehicle, the at least one guide member contacts the at least one lateral side of the at least one track member to prohibit horizontal movement of the front loading fork with respect to the refuse vehicle and the guide member can contact the at least one track member below the bumper to enable adjustment of the front loading fork to accommodate intermediate containers.

2. The track and guide system of claim 1, further comprising a wear pad on one of the at least one track member or at least one guide member.

3. The track and guide system of claim 1, further comprising gusset plates coupled with both the track member and guide member for providing strength in a direction of an applied force.

4. The track and guide system of claim 1, wherein the length of the at least one track member enables contact with the at least one guide member as the front loading fork raises vertically.

5. The track and guide system of claim 1, wherein the at least one track member includes a first portion for attaching with the refuse vehicle and a second portion contacting the at least one guide member, the second portion is substantially transverse to the first portion.

6. The track and guide system of claim 1, wherein the at least one track member and at least one guide member further comprising a pair of track members and a pair of guide members.

7. The track and guide system of claim 1, wherein the at least one guide member is sandwiched by the at least one track member.

8. The track and guide system of claim 7, wherein the at least one track member including a pair of plates sandwiching the at least one guide member.

9. A refuse vehicle comprising:

a vehicle chassis including a cab;

a container coupled within the rear portion of the chassis; and front loading forks, with a cross bar between a pair of side bars and extending tines, the pair of side bars pivotally coupled with the refuse vehicle for dumping intermediate containers into the container on the rear of the chassis;

at least one track member with at least one lateral side in a plane, vertical with respect to the refuse vehicle, the at least one track member is mounted on a bumper of the refuse vehicle, the at least one track member has a desired length extending from the bumper so that a portion of the at least one track member extends below the bumper of the refuse vehicle; and at least one guide member, the at least one guide member is mounted on the cross bar of the front loading forks of the refuse vehicle, the at least one guide member contacts the at least one lateral side of the at least one track member to prohibit horizontal movement of the front loading fork with respect to the refuse vehicle and the guide member can contact the at least one track member below the bumper to enable adjustment of the front loading fork to accommodate the intermediate containers.

10. The refuse vehicle of claim 9, further comprising a wear pad on one of the at least one track member or at least one guide member.

11. The refuse vehicle of claim 9, further comprising gusset plates coupled with both the at least one track member and the at least one guide member for providing strength in a direction of an applied force.

12. The refuse vehicle of claim 9, wherein the length of the at least one track member enables contact with the at least one guide member as the front loading fork rises vertically.

13. The refuse vehicle of claim 9, wherein the at least one track member includes a first portion for attaching with the refuse vehicle and a second portion contacting the at least one guide member, the second portion is substantially transverse to the first portion.

14. The refuse vehicle of claim 9, wherein the at least one track member and at least one guide member further comprising a pair of track members and a pair of guide members.

15. The refuse vehicle of claim 9, wherein the at least one guide member is sandwiched by the at least one track member.

16. The refuse vehicle of claim 15, wherein the at least one track member including a pair of plates sandwiching the at least one guide member.

* * * * *